US009449470B2

(12) United States Patent
Baerlocher et al.

(10) Patent No.: US 9,449,470 B2
(45) Date of Patent: Sep. 20, 2016

(54) WAGERING GAME WITH UPGRADABLE SYMBOL STACKS

(71) Applicant: WMS Gaming Inc., Waukegan, IL (US)

(72) Inventors: Anthony J. Baerlocher, Henderson, NV (US); Daniel P. Louie, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 209 days.

(21) Appl. No.: 14/200,009

(22) Filed: Mar. 6, 2014

(65) Prior Publication Data

US 2014/0274294 A1 Sep. 18, 2014

Related U.S. Application Data

(60) Provisional application No. 61/791,435, filed on Mar. 15, 2013.

(51) Int. Cl.
*G07F 17/34* (2006.01)
*G07F 17/32* (2006.01)

(52) U.S. Cl.
CPC ..... *G07F 17/34* (2013.01); *G07F 17/326* (2013.01)

(58) Field of Classification Search
CPC ... G07F 17/3244; G07F 17/326; G07F 17/34
USPC ..... 463/20
See application file for complete search history.

(56) References Cited

U.S. PATENT DOCUMENTS 4,198,052 A 4/1980 Gauselmann
5,152,529 A 10/1992 Okada
5,205,555 A 4/1993 Hamano
5,580,055 A 12/1996 Hagiwara
5,632,485 A 5/1997 Woodland
5,704,835 A 1/1998 Dietz, II
5,720,662 A 2/1998 Holmes, Jr.
5,722,891 A 3/1998 Inoue
5,788,573 A 8/1998 Baerlocher (Continued)

FOREIGN PATENT DOCUMENTS

GB 2 097 160 10/1982
GB 2 117 155 10/1983

(Continued)

OTHER PUBLICATIONS

"Arrow Line" by Bally, 1971 (appearing in Bally Slot Machines, Revised 3rd Edition, Liberty Belle Books, by Marshall Fey, p. 17) (1 page).

(Continued)

*Primary Examiner* — Jay Liddle
(74) *Attorney, Agent, or Firm* — Nixon Peabody LLP

(57) ABSTRACT

A gaming system includes one or more input devices, display devices, processors, and memory devices. At least one of the memory devices store instructions that cause the system to receive a wager and to display at least one array having a plurality of columns. An outcome is randomly selected, in response to the wager, in which a first column is stacked with a stack of symbols of a first rank and a second column is stacked with a stack of symbols of a second rank. The first rank is compared with the second rank to determine a high rank and a low rank according to a predetermined pay table. The stack of symbols of the low rank is upgraded to a stack of symbols of the high rank.

17 Claims, 8 Drawing Sheets

(56) References Cited

U.S. PATENT DOCUMENTS

| | | | | |
|---|---|---|---|---|
| 5,823,874 | A | 10/1998 | Adams | |
| 5,848,932 | A | 12/1998 | Adams | |
| 5,851,148 | A | 12/1998 | Brune | |
| 5,882,261 | A | 3/1999 | Adams | |
| 5,931,467 | A | 8/1999 | Kamille | |
| 5,980,384 | A | 11/1999 | Barrie | |
| 5,984,782 | A | 11/1999 | Inoue | |
| 6,004,207 | A | 12/1999 | Wilson, Jr. | |
| 6,012,982 | A | 1/2000 | Piechowiak | |
| 6,047,963 | A | 4/2000 | Pierce | |
| 6,056,642 | A | 5/2000 | Bennett | |
| 6,068,552 | A | 5/2000 | Walker | |
| 6,089,976 | A | 7/2000 | Schneider | |
| 6,089,977 | A | 7/2000 | Bennett | |
| 6,089,978 | A | 7/2000 | Adams | |
| 6,110,041 | A | 8/2000 | Walker | |
| 6,120,378 | A | 9/2000 | Moody | |
| 6,155,925 | A | 12/2000 | Giobbi | |
| 6,159,095 | A | 12/2000 | Frohm | |
| 6,179,711 | B1 | 1/2001 | Yoseloff | |
| 6,183,366 | B1 | 2/2001 | Goldberg | |
| 6,186,894 | B1 | 2/2001 | Mayeroff | |
| 6,190,255 | B1 | 2/2001 | Thomas | |
| 6,203,429 | B1 | 3/2001 | Demar | |
| 6,210,277 | B1 | 4/2001 | Stefan | |
| 6,227,969 | B1 | 5/2001 | Yoseloff | |
| 6,227,971 | B1 | 5/2001 | Weiss | |
| 6,237,916 | B1 | 5/2001 | Webb | |
| 6,251,013 | B1 | 6/2001 | Bennett | |
| 6,254,481 | B1 | 7/2001 | Jaffe | |
| 6,261,178 | B1 | 7/2001 | Bennett | |
| 6,270,411 | B1 | 8/2001 | Gura | |
| 6,290,600 | B1 | 9/2001 | Glasson | |
| 6,350,199 | B1 | 2/2002 | Williams | |
| 6,394,902 | B1 | 5/2002 | Glavich | |
| 6,413,162 | B1 | 7/2002 | Baerlocher | |
| 6,419,579 | B1 | 7/2002 | Bennett | |
| 6,471,208 | B2 | 10/2002 | Yoseloff | |
| 6,485,367 | B1 | 11/2002 | Joshi | |
| 6,517,432 | B1 | 2/2003 | Jaffe | |
| 6,520,856 | B1 | 2/2003 | Walker | |
| 6,544,120 | B2 | 4/2003 | Ainsworth | |
| 6,561,904 | B2 | 5/2003 | Locke | |
| 6,565,433 | B1 | 5/2003 | Baerlocher | |
| 6,582,306 | B1 | 6/2003 | Kaminkow | |
| 6,589,114 | B2 | 7/2003 | Rose | |
| 6,605,000 | B2 | 8/2003 | Adams | |
| 6,612,574 | B1 | 9/2003 | Cole | |
| 6,632,140 | B2 | 10/2003 | Berman | |
| 6,634,945 | B2 | 10/2003 | Glavich | |
| 6,641,477 | B1 | 11/2003 | Dietz, II | |
| 6,746,328 | B2 | 6/2004 | Cannon | |
| 6,749,504 | B2 | 6/2004 | Hughs-Baird | |
| 6,793,578 | B2 | 9/2004 | Luccesi | |
| 6,805,629 | B1 | 10/2004 | Weiss | |
| 6,855,054 | B2 | 2/2005 | White | |
| 6,860,810 | B2 | 3/2005 | Cannon | |
| 6,908,390 | B2 | 6/2005 | Nguyen | |
| 6,916,243 | B2 | 7/2005 | Yoshida | |
| 6,960,133 | B1 | 11/2005 | Marks | |
| 7,056,213 | B2 | 6/2006 | Ching | |
| 7,090,580 | B2 | 8/2006 | Rodgers | |
| 7,094,148 | B2 | 8/2006 | Baerlocher | |
| 7,252,589 | B1 | 8/2007 | Marks | |
| 7,780,519 | B2 * | 8/2010 | Gomez | G07F 17/3244 463/13 |
| 8,002,626 | B2 | 8/2011 | Englman | |
| 2002/0010017 | A1 | 1/2002 | Bennett | |
| 2002/0020965 | A1 | 2/2002 | Potter | |
| 2002/0055382 | A1 | 5/2002 | Meyer | |
| 2002/0068623 | A1 | 6/2002 | Gauselmann | |
| 2002/0086725 | A1 | 7/2002 | Fasbender | |
| 2002/0115488 | A1 | 8/2002 | Berry | |
| 2002/0142825 | A1 | 10/2002 | Lark | |
| 2002/0142846 | A1 | 10/2002 | Paulsen | |
| 2002/0155881 | A1 | 10/2002 | Yoshida | |
| 2002/0196342 | A1 | 12/2002 | Walker | |
| 2003/0022713 | A1 | 1/2003 | Jasper | |
| 2003/0027623 | A1 | 2/2003 | Rose | |
| 2003/0027626 | A1 | 2/2003 | Marks | |
| 2003/0032470 | A1 | 2/2003 | Weiss | |
| 2003/0054872 | A1 | 3/2003 | Locke | |
| 2003/0064779 | A1 | 4/2003 | Suda | |
| 2003/0064796 | A1 | 4/2003 | Glavich | |
| 2003/0064797 | A1 | 4/2003 | Jackson | |
| 2003/0064800 | A1 | 4/2003 | Jackson | |
| 2003/0069062 | A1 | 4/2003 | Shimizu | |
| 2003/0083121 | A1 | 5/2003 | Cole | |
| 2003/0092480 | A1 | 5/2003 | White | |
| 2003/0119579 | A1 | 6/2003 | Walker | |
| 2003/0162585 | A1 | 8/2003 | Bigelow | |
| 2003/0216165 | A1 | 11/2003 | Singer | |
| 2003/0216169 | A1 | 11/2003 | Walker | |
| 2004/0048646 | A1 | 3/2004 | Visocnik | |
| 2004/0051239 | A1 | 3/2004 | Seelig | |
| 2004/0053683 | A1 | 3/2004 | Hartl | |
| 2004/0092299 | A1 | 5/2004 | Gauselmann | |
| 2004/0092300 | A1 | 5/2004 | Gauselmann | |
| 2004/0100025 | A1 | 5/2004 | Conklin | |
| 2004/0137982 | A1 | 7/2004 | Cuddy | |
| 2004/0219968 | A1 | 11/2004 | Fiden | |
| 2004/0219969 | A1 | 11/2004 | Casey | |
| 2004/0242316 | A1 | 12/2004 | Oles | |
| 2004/0259631 | A1 | 12/2004 | Katz | |
| 2004/0266507 | A1 | 12/2004 | Cooper | |
| 2005/0026673 | A1 | 2/2005 | Paulsen | |
| 2005/0054412 | A1 | 3/2005 | Gauselmann | |
| 2005/0096113 | A1 | 5/2005 | Gabuchian | |
| 2005/0130731 | A1 | 6/2005 | Englman | |
| 2005/0130737 | A1 | 6/2005 | Englman | |
| 2005/0159208 | A1 | 7/2005 | Pacey | |
| 2005/0197182 | A1 | 9/2005 | Duhamel | |
| 2006/0058097 | A1 | 3/2006 | Berman | |
| 2006/0068892 | A1 * | 3/2006 | Gomez | G07F 17/34 463/20 |
| 2006/0154717 | A1 | 7/2006 | Jackson | |
| 2006/0189377 | A1 * | 8/2006 | Gomez | G07F 17/3244 463/20 |
| 2006/0211484 | A1 | 9/2006 | Hornik | |
| 2007/0155474 | A1 | 7/2007 | Gauselmann | |
| 2009/0017989 | A1 * | 1/2009 | Karlsson | B60W 10/02 477/181 |
| 2009/0286592 | A1 * | 11/2009 | Vann | G07F 17/34 463/20 |
| 2010/0273550 | A1 | 10/2010 | Marks | |
| 2014/0162749 | A1 * | 6/2014 | Ryan | G07F 17/3244 463/20 |
| 2014/0179398 | A1 * | 6/2014 | Vandaele | G07F 17/34 463/20 |

FOREIGN PATENT DOCUMENTS

| | | |
|---|---|---|
| GB | 2 117 952 | 10/1983 |
| GB | 2 130 413 | 5/1984 |
| WO | WO 97-19736 | 6/1997 |
| WO | WO 97-57569 | 7/1997 |
| WO | WO 00-32286 | 6/2000 |
| WO | WO 01-15055 A1 | 3/2001 |
| WO | WO 01-33478 A1 | 5/2001 |
| WO | WO 02-054331 A2 | 7/2002 |
| WO | WO 03-089084 A1 | 10/2003 |

OTHER PUBLICATIONS

"Extra Line" by Bally, 1971 (appearing in Bally Slot Machines, Revised 3rd Edition, Liberty Belle Books, by Marshall Fey, p. 23) (1 page).

"Lucky Twins Continental" by Bally, 1972 (appearing in Bally Slot Machines, Revised 3rd Edition, Liberty Belle Books, by Marshall Fey, p. 26) (1 page).

"Twin Lightning" by Bally, 1972 (appearing in Bally Slot Machines, Revised 3rd Edition, Liberty Belle Books, by Marshall Fey, p. 28) (1 page).

(56) References Cited

OTHER PUBLICATIONS

"Double or Nothing" by Bally Distributing Company, approx. 1975 (appearing in Lemons, Cherries, and Bell-Fruit-Gum, by Richard M. Bueschel, 1995, p. 267) (1 page).
"Fistful of Fives" by Jubilee, pre-1994 (1 page).
WMS Gaming Inc., "Top Cat" ™ Product Sheet, estimated 1995, Chicago, IL (2 pages).
WMS Gaming Inc., "Big Bang Piggy Bankin"'TM, Product Sheet, 1996, Chicago, IL (1 page).
WMS Gaming Inc., "Winning Streak"™, Product Sheet, 1997, Chicago, IL (2 pages).
WMS Gaming Inc., "Stroke of Luck"™, Product Sheet, 1998, Chicago, IL (2 pages).
PR Newswire, Atronic's Rock and Rollin' Installed in Nevada, Jun. 20, 2000, Fulltext (1 page).
International Search Report for International Application No. PCT-US-2006-01651, dated Sep. 16, 2006 (2 pages).
PCT International Search Report for International Application No. PCT-US-2006-26360 mail dated Apr. 4, 2007 (3 pages).

* cited by examiner

WAGERING GAME WITH UPGRADABLE SYMBOL STACKS

CROSS-REFERENCE TO RELATED APPLICATIONS

This application claims the benefit of and priority to U.S. Provisional Patent Application No. 61/791,435, titled "Wagering Game With Upgradable Symbol Stacks" and filed on Mar. 15, 2013, which is incorporated herein by reference in its respective entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming apparatus and methods and, more particularly, to a gaming system in which symbols of stacked columns are upgraded to the highest rank of the symbols.

BACKGROUND OF THE INVENTION

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

Traditionally, gaming machines operate under control of a processor that has been programmed to execute base games and bonus games in which reel arrays spin and stop to display symbol combinations in a display area. If winning combinations are achieved by the symbol combinations, awards are provided to the players.

SUMMARY OF THE INVENTION

According to one aspect of the present invention, a gaming system includes one or more input devices, one or more display devices, one or more processors, and one or more memory devices. At least one of the one or more memory devices stores instructions for execution by at least one of the one or more processors. The instructions cause the system to receive a wager and to display at least one array having a plurality of columns. An outcome is randomly selected, in response to the wager, in which a first column is stacked with a stack of symbols of a first rank and a second column is stacked with a stack of symbols of a second rank. The first rank is compared with the second rank to determine a high rank and a low rank, according to a predetermined pay table. The stack of symbols of the low rank is upgraded to a stack of symbols of the high rank.

According to another aspect of the invention, a gaming system includes one or more input devices, one or more display devices, one or more processors, and one or more memory devices. At least one of the one or more memory devices stores instructions for execution by at least one of the one or more processors. The instructions cause the gaming system to receive a wager in response to an input via at least of the one or more input devices, and to display on at least one of the one or more display devices at least one array comprising a plurality of columns. The columns have symbol positions for being populated with symbols having a rank assigned according to a predetermined pay table. In response to an initial spin, a first outcome is achieved in which a first column of the plurality of columns is a stacked column. The stacked column has all the column positions populated with a stack of symbols of a first rank. Other columns are non-stacked columns with column positions populated with symbols of different ranks. In response to the first outcome, the first column is maintained with the stack of symbols of the same first rank while the non-stacked columns are re-spun. In response to the re-spinning, a second outcome is achieved in which a second column of the non-stacked columns is now a stacked column with all column positions being populated with a stack of symbols of a second rank. The first rank is compared with the second rank to determine a high rank and a low rank according to the predetermined pay table. The stack of symbols of the low rank is upgraded to a stack of symbols of the high rank.

According to a further aspect of the invention, a computer-implemented method in a gaming system includes receiving a wager in response to an input via at least one of one or more input devices, and displaying on at least one of one or more display devices at least one array with a plurality of columns. In response to the wager, an outcome is randomly selected, by at least one of one or more processors, in which a first column is stacked with a stack of symbols of a first rank and a second column is stacked with a stack of symbols of a second rank. The first rank is compared with the second rank, by at least one of the one or more processors, to determine a high rank and a low rank according to a predetermined pay table. The stack of symbols of the low rank is upgraded, by at least one of the one or more processors, to a stack of symbols of the high rank.

Additional aspects of the invention will be apparent to those of ordinary skill in the art in view of the detailed description of various embodiments, which is made with reference to the drawings, a brief description of which is provided below.

Figure 1:
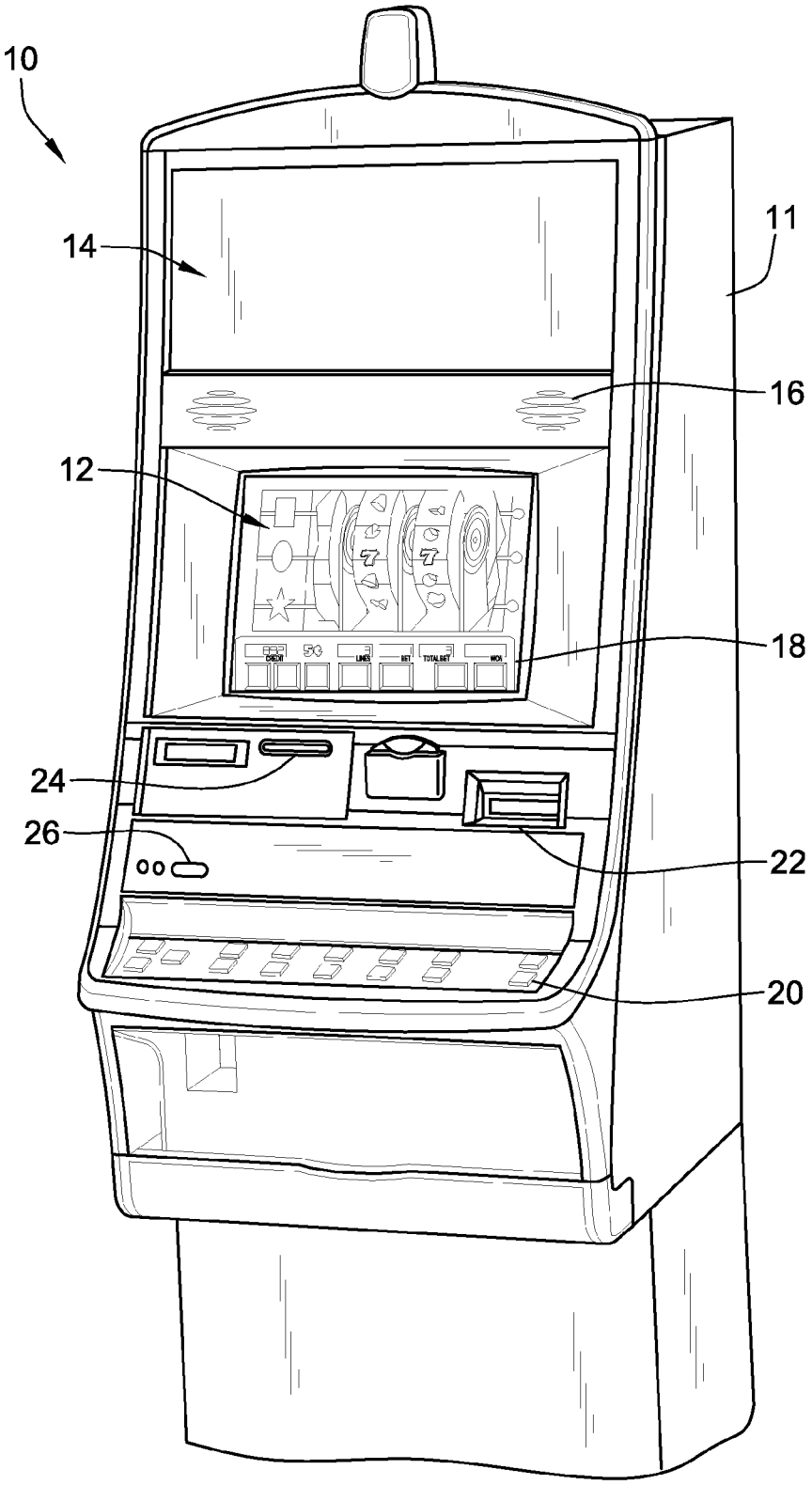
FIG. 1 (PRIOR ART)
FIG. 1 is a perspective view of a free-standing gaming terminal.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering games," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game may involve wagers of real money, as found with typical land-based or on-line casino games. In other embodiments, the wagering game may additionally, or alternatively, involve wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIG. 1, there is shown a gaming terminal 10 similar to those used in gaming establishments, such as casinos. With regard to the present invention, the gaming terminal 10 may be any type of gaming terminal and may have varying structures and methods of operation. For example, in some aspects, the gaming terminal 10 is an electromechanical gaming terminal configured to play mechanical slots, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models as shown, handheld mobile units, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433 and Patent Application Publication Nos. US2010/0069160 and US2010/0234099, which are incorporated herein by reference in their entireties.

The gaming terminal 10 illustrated in FIG. 1 comprises a cabinet 11 that may house various input devices, output devices, and input/output devices. By way of example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming terminal 10. The gaming terminal 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Figure 2:
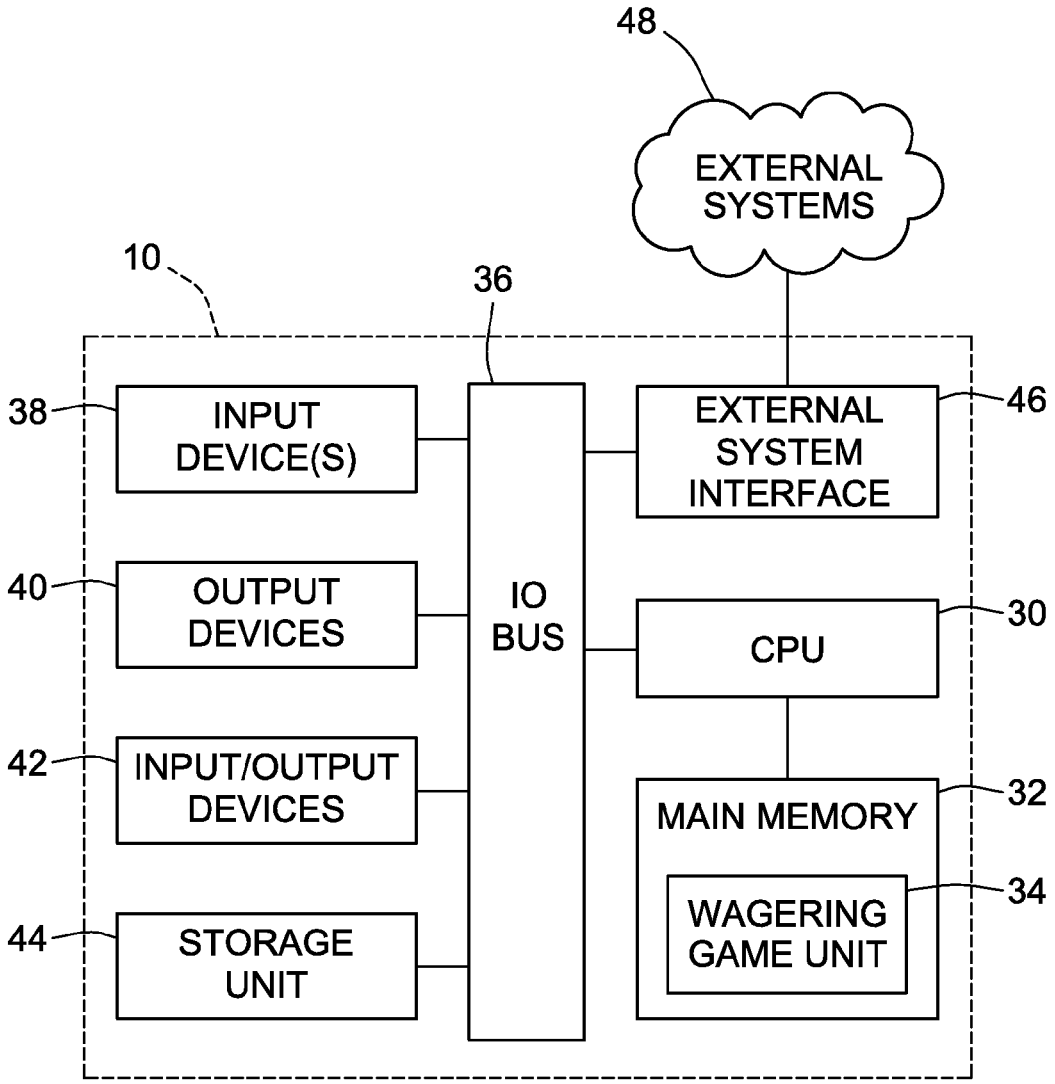
FIG. 2 (PRIOR ART)
FIG. 2 is a schematic view of a gaming system.

Turning now to FIG. 2, there is shown a block diagram of the gaming-terminal architecture. The gaming terminal 10 includes a central processing unit (CPU) 30 connected to a main memory 32. The CPU 30 may include any suitable processor(s), such as those made by Intel and AMD. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations. The CPU 30 is operable to execute all of the various gaming methods and other processes disclosed herein. The main memory 32 includes a wagering game unit 34. In one embodiment, the wagering game unit 34 may present wagering games, such as video poker, video black jack, video slots, video lottery, etc., in whole or part.

The CPU 30 is also connected to an input/output (I/O) bus 36, which can include any suitable bus technologies, such as an AGTL+ frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks).

The external system 48 includes, in various aspects, a gaming network, other gaming terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum RF signals (e.g., Bluetooth, etc.).

The gaming terminal 10 optionally communicates with the external system 48 such that the terminal operates as a thin, thick, or intermediate client. In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 3:
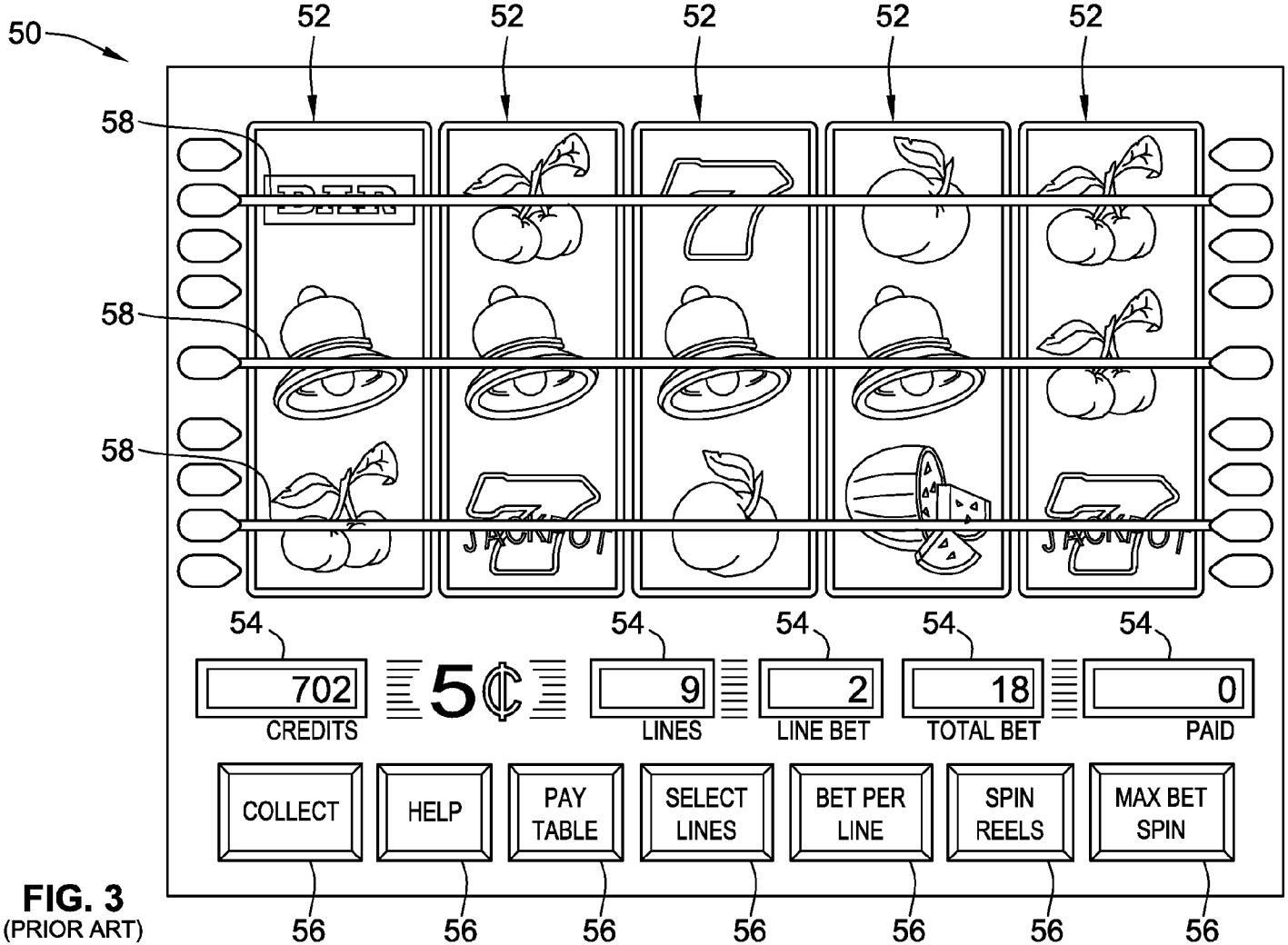
FIG. 3 (PRIOR ART)
FIG. 3 is an image of an exemplary basic-game screen of a wagering game displayed on a gaming terminal.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The CPU operate(s) to execute a wagering game program causing the primary display area 12 or the secondary display area 14 to display the wagering game.

In response to receiving a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 30) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by a RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

Figure 4:
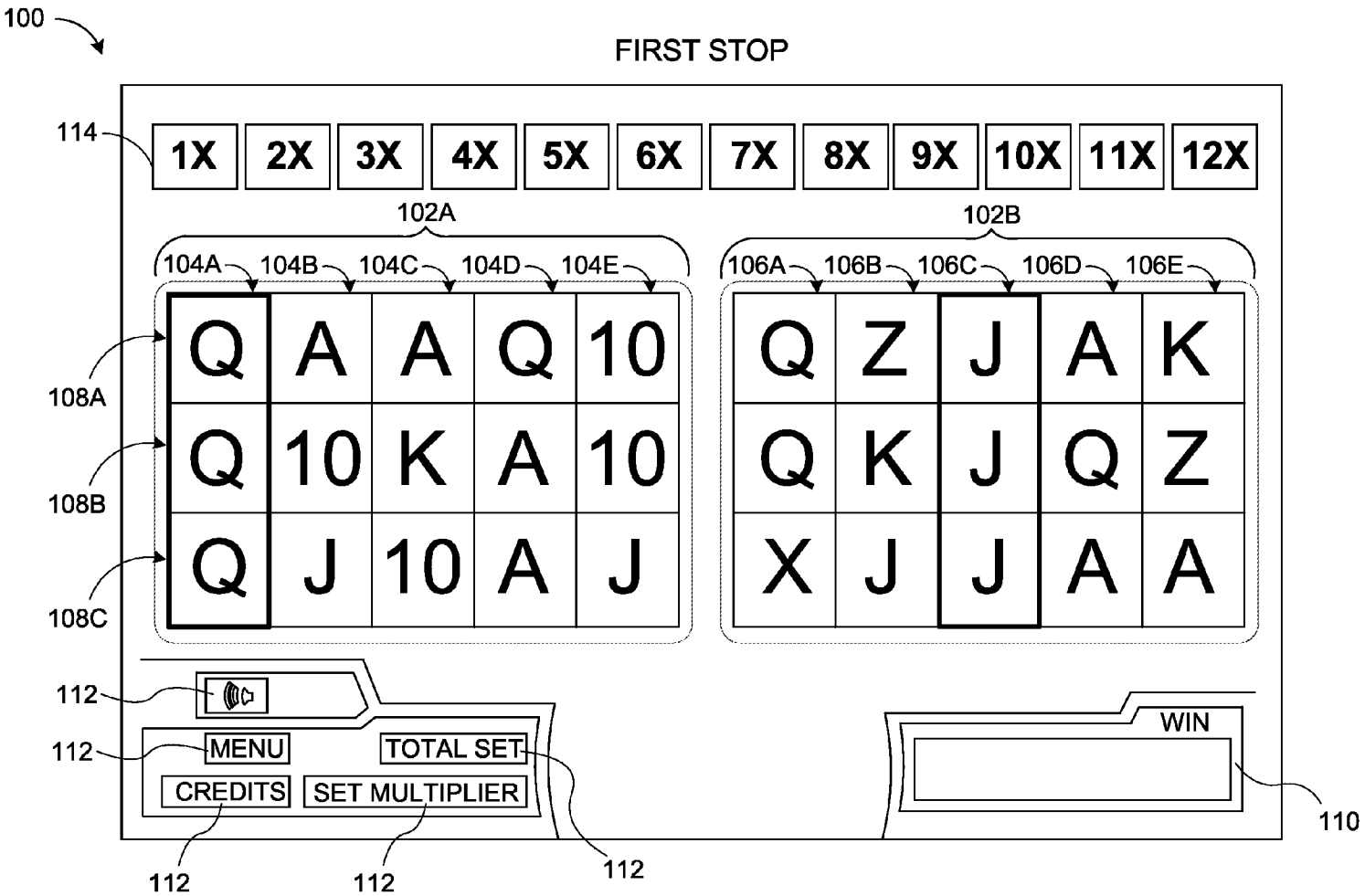
FIG. 4 is an image of a screen displaying an initial outcome of two arrays of reels.

Referring now to FIG. 4, an illustrated image of a wagering game screen 100 is adapted to be displayed on the primary display area 12 or the secondary display area 14. The game screen 100 portrays two arrays—a left array 102A and a right array 102B—with a plurality of symbol-bearing reels 104A-104E, 106A-106E. The reels include first reels 104A, 106A (left reels), second reels 104B, 106B (left-center reels), third reels 104C, 106C (center reels), fourth reels 104D, 106D (right-center reels), and fifth reels 104E, 106E (right reels). Each of the reels 104A-104E, 106A-106E has three positions, including a top position 108A, a center position 108B, and a bottom position 108C. Thus, in this example, each array is a 5×3 array with five reels (or columns) and three rows. In other examples, the arrays can have a different number of columns and rows and the columns may be formed by reels or any other suitable mechanic to populate the array, such as cascading symbols or other visual illustration of symbols populating the array positions.

Each position of each reel 104A-104E, 106A-106E is a symbol position that is populated with a respective symbol. For example, a "Q" symbol has populated the top position 108A of the left reel 104A in the left array 102A. As reels spin to indicate different outcomes, the symbols in each reel are randomly selected and, often (but not necessarily), show different symbols in the same position after each spin.

The symbols include, for example, "10" symbols, "J" symbols, "Q" symbols, "K" symbols, and "A" symbols. Each of the symbols has an assigned rank, in accordance with a particular hierarchy, that is associated with a respective potential winning payout. The hierarchy is determined according to a predetermined pay table. For example, a winning combination with "A" symbols is deemed to have a higher rank than "K" symbols, a winning combination with "K" symbols is deemed to have a higher rank than "Q" symbols, a winning combination with "Q" symbols is deemed to have a higher rank than "J" symbols, and a winning combination with "J" symbols is deemed to have a higher rank than "10" symbols. As such, achieving a winning combination with "K" symbols will result in a greater winning payout than achieving a winning combination with "Q" symbols.

The reels 104A-104E, 106A-106E are populated by strings of symbols generally known as reel strips. For the purposes of the present invention, these reel strips contain various types of symbols such as the "royal" symbols described in the previous paragraph. In addition, the reel strips may be populated with wild symbols, bonus symbols, scatter symbols, bells, sevens, bars, theme-specific symbols, or any other type of symbol. The reel strips include clumps (or stacks) of symbols that are formed either by oversized symbols or from several identical, individual symbols being located adjacent to one another (for example, reels 104A and 106C in FIG. 4). The reel strips may also include individual symbols distributed thereon (such as those illustrated, for example, on reels 104B and 106B). In general, each reel includes at least one clump or stack of symbols that is equal in height, or greater, than the height of the arrays 102A, 102B.

The arrays 102A, 102B are illustrated as being displayed on a single display area. However, in other examples, the arrays 102A, 102B can be displayed on respective display areas. For example, the left array 102A can be displayed on the primary display area 12 and the right array 102B can be displayed on the secondary display area 14. Furthermore, in other examples the game screen 100 can include any number of arrays, e.g., one array, three arrays, four arrays, etc.

The game screen 100 also advantageously displays at least one game-session credit meter 110, various touch screen buttons 112 adapted to be actuated by a player, and a plurality of multiplier indicators 114. A player can operate or interact with the wagering game using these touch screen buttons or other input devices such as the buttons 20 shown in FIG. 1. The CPU operate(s) to execute a wagering game program causing the primary display area 12 or the secondary display area 14 to display the wagering game.

The game screen 100 is illustrated after a first (or initial) stop of the reels 104A-104E, 106A-106E and shows a first outcome in which two reels are stacked reels. The left reel 104A of the left array 102A is a reel stacked with "Q" symbols in each position (top, center, and bottom positions 108A-108C). In other words, the left reel 104A is stacked with the same symbol in each position. The center reel 106C of the right array 102B is a reel stacked with "J" symbols in each position (top, center, and bottom positions 108A-108C). The symbols of the arrays 102A, 102B are evaluated along respective active paylines (as known in the art) and corresponding payouts are provided for any winning combinations.

Figure 5:
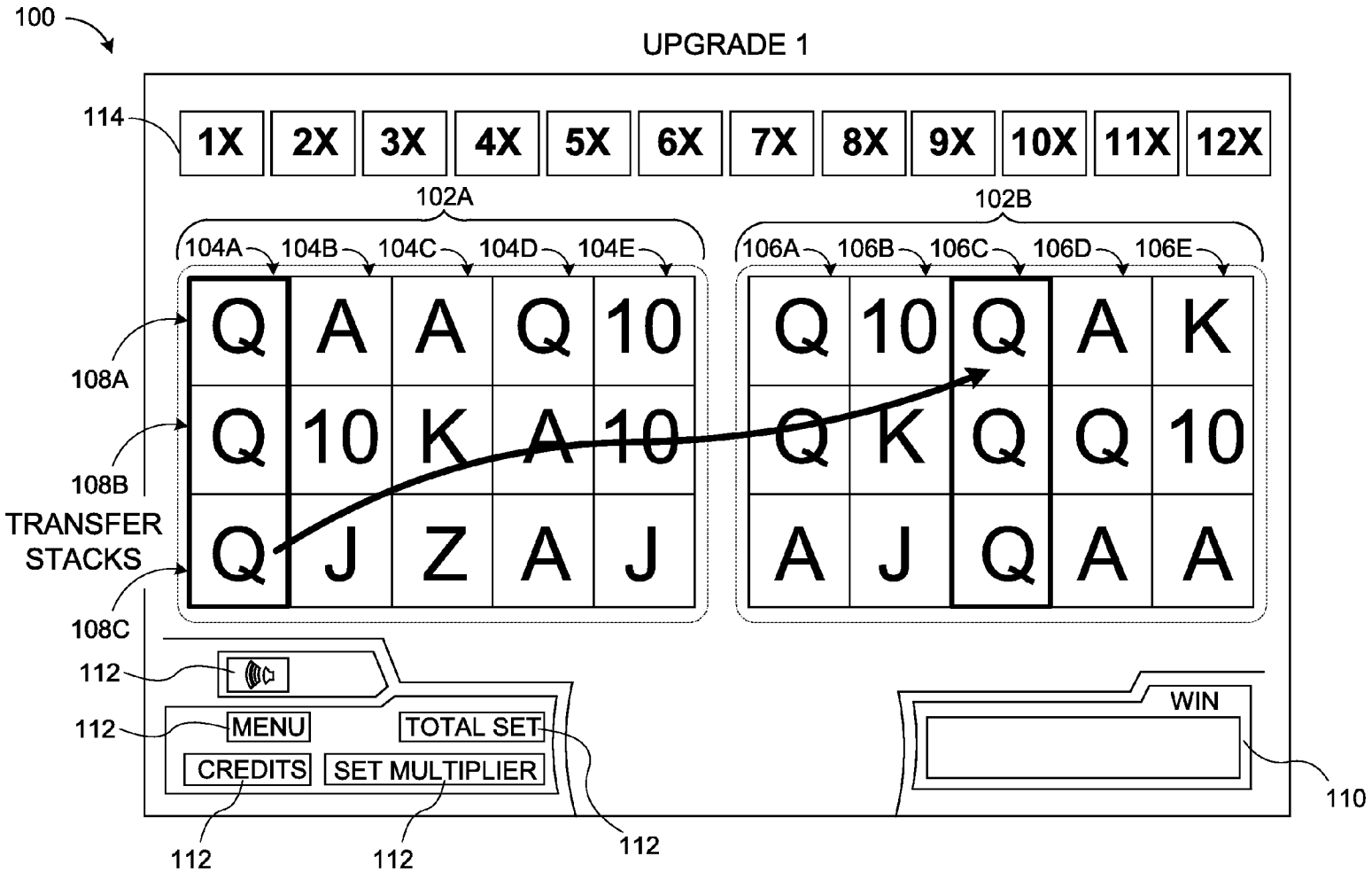
FIG. 5 is an image illustrating upgrading stacked symbols of two reels of the two arrays of FIG. 4.

Referring to FIG. 5, the stacked reels are upgraded such that each stacked reel has the higher-ranked symbols of the two stacked reels. Specifically, a determination is made that the stacked center reel 106C has symbols of a lower rank than the symbols of the stacked left reel 104A (i.e., "J" symbols<"Q" symbols). Accordingly, the "J" symbols of the stacked center reel 106C are upgraded (or changed) to the higher rank of "Q" symbols of the stacked left reel 104A. The upgrading of the stacked center reel 106C achieves synchronization of all current stacked reels 104A, 106C to display the highest-ranked symbols (i.e., "Q" symbols) in each stacked reel 104A, 106C.

Figure 6:
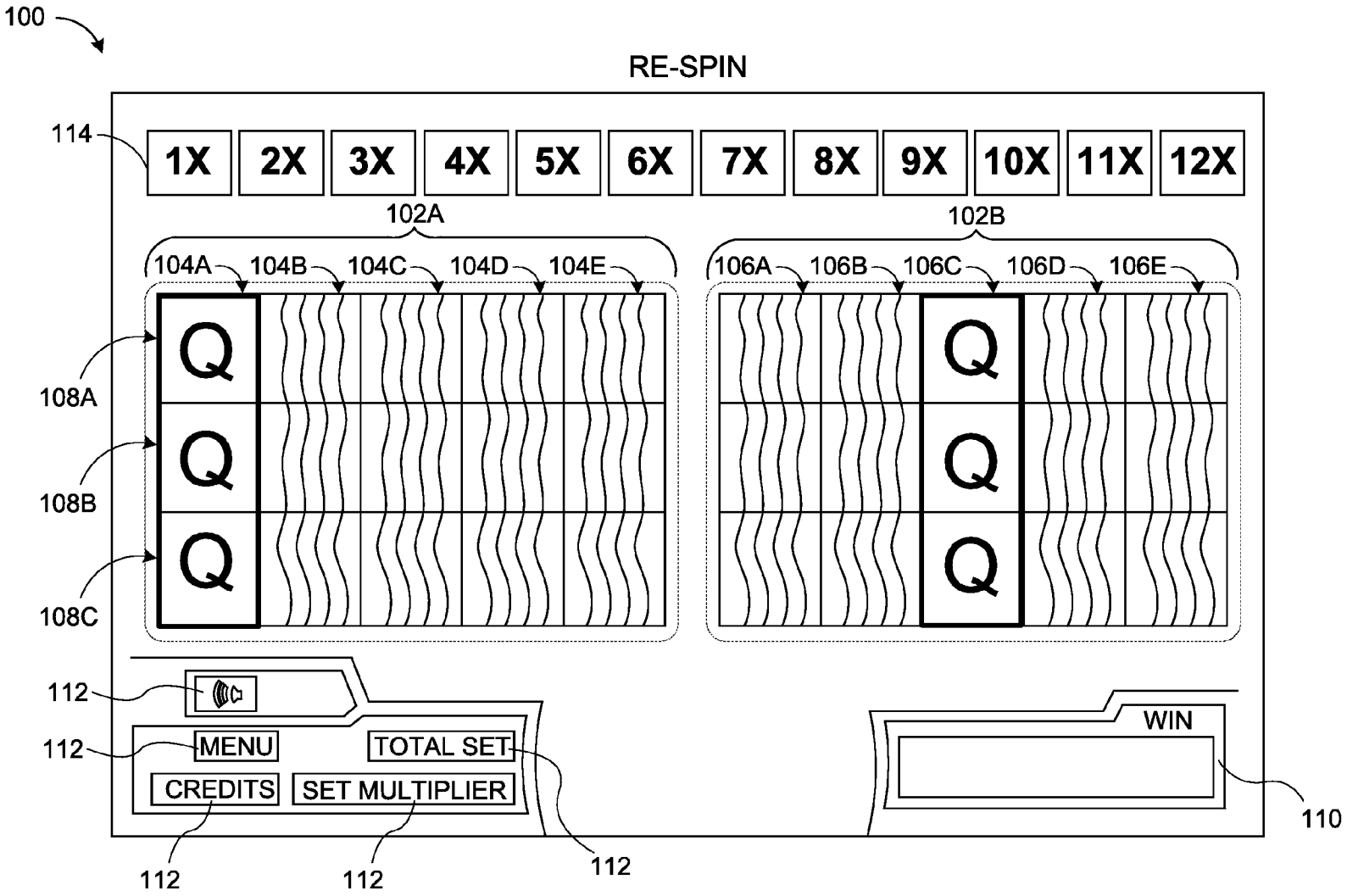
FIG. 6 is an image illustrating re-spinning non-stacked reels of the two arrays of FIG. 5.

Referring to FIG. 6, the stacked reels 104A, 106C are maintained in their upgraded condition while the remaining non-stacked reels are re-spun. In some embodiments, the re-spinning is optional and may result in response to the upgrading of the stacked center reel 106C.

Figure 7:
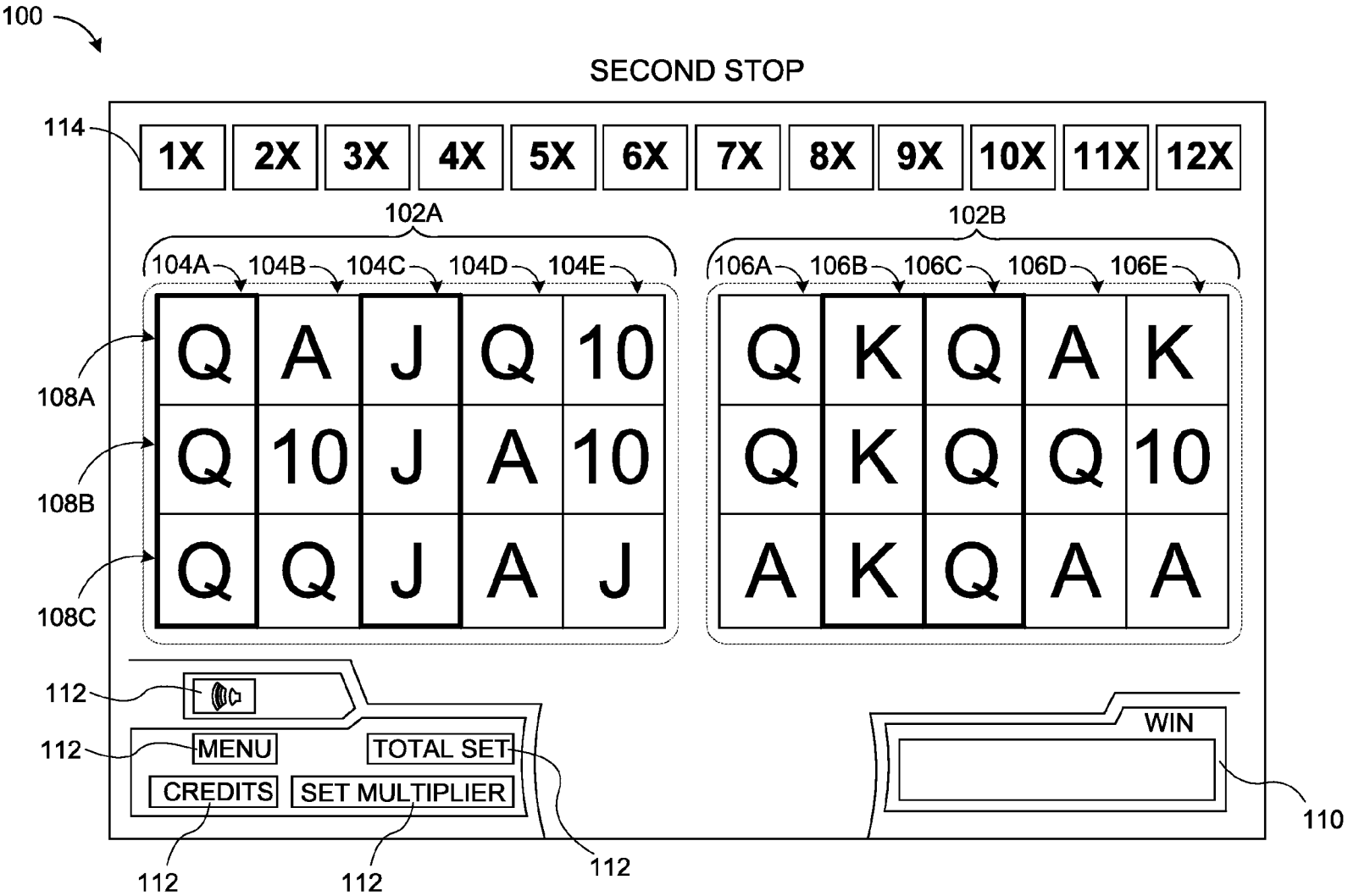
FIG. 7 is an image illustrating a subsequent outcome of the two arrays of FIG. 6.

Referring to FIG. 7, the game screen 100 is illustrated after a second stop of the reels 104A-104E, 106A-106E and shows a second outcome in which two additional reels are stacked reels. The center reel 104C of the left array 102A is stacked with "J" symbols in each position 108A-108C, and the left-center reel 106B of the right array 102B is stacked with "K" symbols in each position 108A-108C. Thus, the game screen 100 shows a total of four stacked reels 104A, 104C, 106B, 106C and a total of six non-stacked reels 104B, 104D, 104E, 106A, 106D, 106E.

Figure 8:
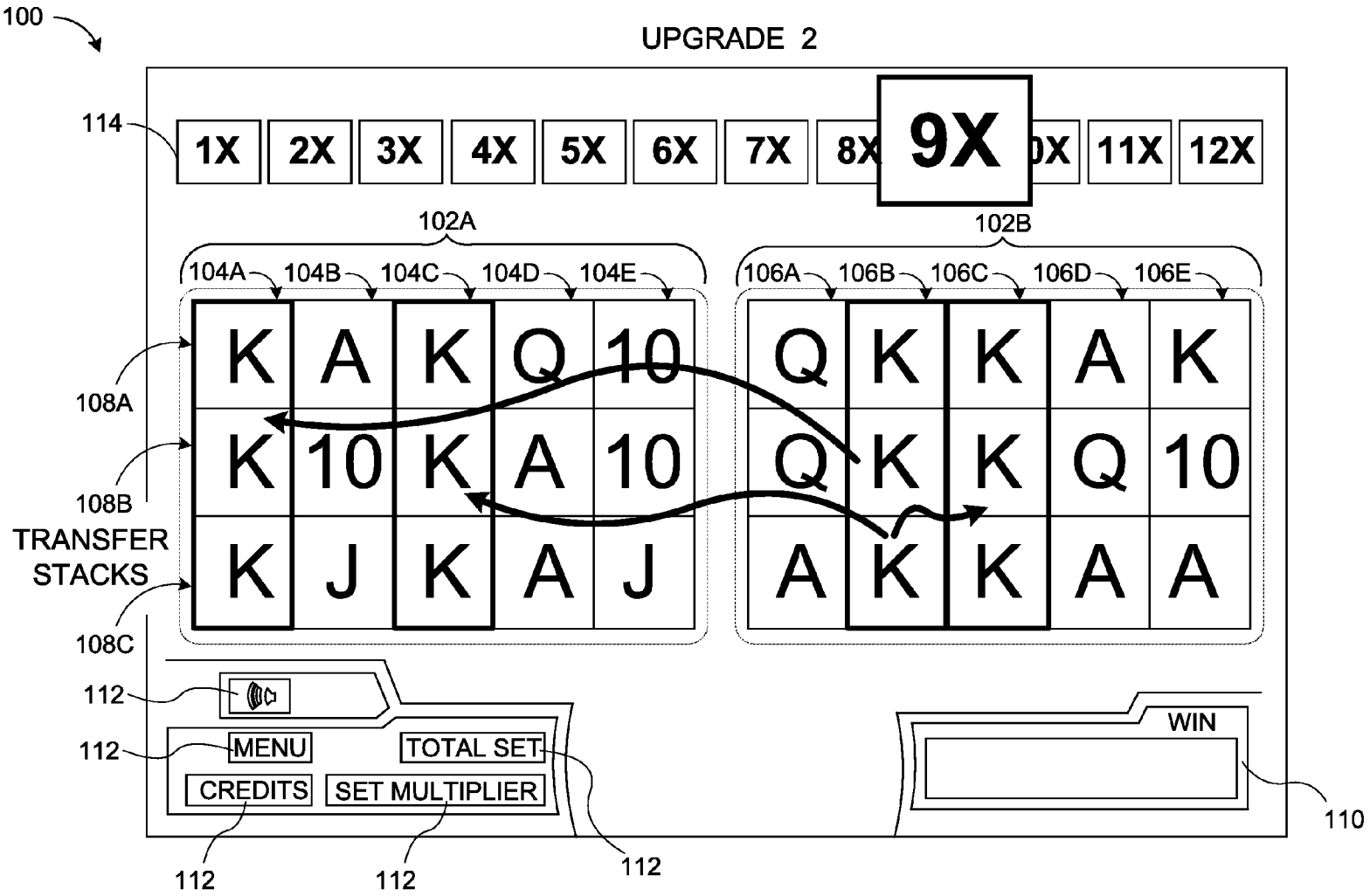
FIG. 8 is an image illustrating upgrading stacked symbols of two additional reels of the two arrays of FIG. 7.

Referring to FIG. 8, a second upgrade occurs in which lower rank symbols are upgraded to higher rank symbols. A determination is made that the stacked left-center reel 106B of the right array 102B has the highest-ranked symbols ("K" symbols) among all the stacked reels 104A, 104C, 106B, 106C. As such, all the stacked reels are synchronized by upgrading to "K" symbols the "Q" symbols of the left reel 104A in the left array 102A, the "J" symbols of the center reel 104C in the left array 102A, and the "Q" symbols of the center reel 106C in the right array 102B. The symbols of the arrays 102A, 102B are evaluated, again, and corresponding payouts are provided for any further winning combinations. Thus, in this example, pay evaluation occurs after each re-spin.

According to an optional feature, the arrays 102A, 102B continue to spin until no more stacked reels are achieved. Thus, if the six non-stacked reels spin again after the second upgrade and no stacked reels are achieved, the upgrading ends.

According to an optional feature, a multiplier 114 can be assigned based on the achieved stacked reels. For example, a 9× multiplier 114 is assigned in response to achieving the four stacked reels 104A, 104C, 106B, 106C. According to an alternative feature, the multiplier can be based on the number of stacked reels, the position of the stacked reels, and/or the symbols of the stacked reels.

According to another optional feature, the stacking of the reels includes populating with the same symbol less than all the positions of a respective reel. For example, the left reel 104A of the left array 102A can be deemed to be a stacked reel if only the center and bottom positions 108B, 108C include a "Q" symbol in the initial outcome.

According to another optional feature, a pick-bonus feature provides a resetting of at least one array 102A, 102B to provide continual wins and/or increasing multipliers. For example, if the left array 102A has four stacked reels, and, upon re-spinning, a non-stacked fifth reel is achieved, the pick-bonus feature provides further re-spinning of the arrays by re-setting the four stacked reels to non-stacked reels. The re-setting optionally provides an enhanced multiplier for the player (e.g., a current multiplier of 3× is increased to 5×).

According to another optional feature, a stacked reel may be upgraded prior to a re-spinning of reels independent of whether other stacked reels have been achieved. For example, referring to FIG. 4, the left reel 104A of the left array 102A may be the only stacked reel of the left array 102A and the right arrays 102B. In other words, the center reel 106C of the right array 102B is a non-stacked reel in this example. The left reel 104A of the left array 102A can still be upgraded to "Q" (or other higher-ranked) symbols prior to the re-spinning.

According to another optional feature, stacks of symbols synchronize based on reel position (instead of synchronizing based on highest rank). For example, referring to FIG. 8, the stacks of symbols synchronize with the left reel 104A of the left array 102A. All other stacked reels, e.g., 104C, 106B, 106C, change to "Q" symbols regardless of rank.

According to another optional feature, other triggering conditions may result in changing stacks of symbols. For example, an additional reel spins to reveal a symbol that, then, substitutes for some or all stacked symbols. In a specific example, referring to FIG. 8, the left-center reel 104B of the left array 102A spins to reveal an "A" symbol in one of the reel positions. In response to the "A" symbol, at least the "Q" symbols of the left reel 104A in the left array 102A are changed to "A" symbols.

A benefit of the features described above is that adding non-stacked symbols is likely to increase the hit frequency. Other benefits are directed to lowering the multi-line wins, allowing larger pay values, and achieving a lower volatility.

Each of these embodiments and obvious variations thereof is contemplated as falling within the spirit and scope of the claimed invention, which is set forth in the following claims.

What is claimed is:

1. A gaming system, comprising:

a gaming machine primarily dedicated to playing at least one casino wagering game, the gaming machine including an electronic display device and one or more electronic input devices; and one or more controllers configured to:

detect, via at least one of the one or more electronic input devices, a physical item associated with a monetary value that establishes a credit balance, initiate the casino wagering game in response to an input indicative of a wager covered by the credit balance, display on the electronic display device at least one array comprising a plurality of columns, randomly select, in response to the wager, an outcome in which a first column is completely stacked with a stack of symbols of a first rank and a second column is completely stacked with a stack of symbols of a second rank, compare the first rank and the second rank to determine a high rank and a low rank according to a predetermined pay table, upgrade the stack of symbols of the low rank to a stack of symbols having the high rank, award an award in response to the outcome meeting a predetermined award criterion, the credit balance being updated to reflect the award, and receive, via at least one of the one or more electronic input devices, a cashout input that initiates a payout from the credit balance.

2. The gaming system of claim 1, wherein, in response to the outcome, the instructions further cause the gaming system to:

maintain the first and second columns with the stacks of symbols of the high rank while re-spinning any non-stacked columns of the plurality of columns to randomly select another outcome, the another outcome including a third column that is stacked with a stack of symbols of a third rank;

compare the third rank and the high rank to determine a new high rank and a new low rank; and upgrade the stack of symbols of the new low rank to a stack of symbols having the new high rank.

3. The gaming system of claim 2, wherein the first rank is the high rank and, in response to the outcome and prior to the re-spinning, the instructions further cause the gaming system to upgrade the stack of symbols of the first rank to a stack of symbols of a fourth rank, the stack of symbols of the fourth rank replacing the stack of symbols of the first rank.

4. The gaming system of claim 1, wherein the at least one array includes a first array and a second array arranged in a side-by-side configuration on at least one of the one or more display devices, each of the first and second arrays having a respective plurality of columns, the first array including the first column and the second array including the second column.

5. The gaming system of claim 1, wherein the at least one array includes five columns, each of the five columns having three symbol positions, the three symbol positions including a top position, a middle position, and a bottom position.

6. A gaming system comprising:

a gaming machine primarily dedicated to playing at least one casino wagering game, the gaming machine including an electronic display device and one or more electronic input devices; and one or more controllers configured to:

detect, via at least one of the one or more electronic input devices, a physical item associated with a monetary value that establishes a credit balance, initiate the casino wagering game in response to an input indicative of a wager covered by the credit balance, display on the electronic display device at least one array comprising a plurality of columns with symbol positions for being populated with symbols having an assigned rank according to a predetermined pay table, in response to an initial spin, achieve a first outcome in which a first column of the plurality of columns is a stacked column with all column positions being populated with a stack of symbols of a first rank, other ones of the plurality of columns being non-stacked columns with column positions being populated with symbols of different ranks, in response to the first outcome, maintain the first column with the stack of symbols of the same first rank and re-spin the non-stacked columns, in response to the re-spin, achieve a second outcome in which a second column of the non-stacked columns is now a stacked column with all column positions being populated with a stack of symbols of a second rank, compare the first rank and the second rank to determine a high rank and a low rank according to the predetermined pay table, upgrade the stack of symbols of the low rank to a stack of symbols having the high rank, award an award in response to either the first outcome or the second outcome meeting a predetermined award criterion, the credit balance being updated to reflect the award, and receive, via at least one of the one or more electronic input devices, a cashout input that initiates a payout from the credit balance.

7. The gaming system of claim 6, wherein, in response to the second outcome, the instructions further cause the gaming system to:

maintain the first and second columns with the stack of symbols of the high rank and cause an additional re-spin of any remaining non-stacked columns of the plurality of columns, in response to the additional re-spin, achieve a third outcome in which a third column of the non-stacked columns is now a stacked column with all column positions being populated with a stack of symbols of a third rank, compare the high rank with the third rank to determine a new high rank and a new low rank according to the predetermined pay table, and upgrade the stack of symbols of the new low rank to a stack of symbols having the new high rank.

8. The gaming system of claim 7, wherein the new high rank is the third rank.

9. The gaming system of claim 6, wherein the at least one array includes a first array and a second array arranged in a side-by-side configuration on at least one of the one or more display devices, each of the first and second arrays having a respective plurality of columns, the first array including the first column and the second array including the second column.

10. The gaming system of claim 6, wherein the at least one array includes five columns, each of the five columns having three symbol positions, the three symbol positions including a top position, a middle position, and a bottom position.

11. The gaming system of claim 6, wherein, in response to the second outcome, the instructions further cause the gaming system to provide another award if another winning combination is achieved.

12. The gaming system of claim 6, wherein, in response to the first outcome and prior to the re-spin, the instructions further cause the gaming system to upgrade the stack of symbols of the first rank to a stack of symbols of a higher rank.

13. A method of operating a gaming system, the gaming system including one or more controllers and a gaming machine, the gaming machine primarily dedicated to playing at least one casino wagering game, the gaming machine including an electronic display device and one or more electronic input devices, the method comprising:

detecting, via at least one of the one or more electronic input devices, a physical item associated with a monetary value that establishes a credit balance;

initiating the casino wagering game in response to an input indicative of a wager covered by the credit balance;

displaying on the electronic display device at least one array comprising a plurality of columns;

randomly selecting, by at least one of the one or more controllers, in response to the wager, an outcome in which a first column is stacked with a stack of symbols of a first rank and a second column is stacked with a stack of symbols of a second rank;

comparing, by at least one of the one or more controllers, the first rank and the second rank to determine a high rank and a low rank according to a predetermined pay table;

upgrading, by at least one of the one or more controllers, the stack of symbols of the low rank to a stack of symbols having the high rank;

awarding an award in response to the outcome meeting a predetermined award criterion, the credit balance being updated to reflect the award, and receiving, via at least one of the one or more electronic input devices, a cashout input that initiates a payout from the credit balance.

14. The computer-implemented method of claim 13, further comprising:

maintaining the first and second columns with the stack of symbols of the high rank while re-spinning any non-stacked columns of the plurality of columns to randomly select another outcome, the another outcome including a third column that is stacked with a stack of symbols of a third rank;

comparing the third rank and the high rank to determine a new high rank and a new low rank according to the predetermined pay table; and upgrading the stack of symbols of the new low rank to a stack of symbols having the new high rank.

15. The computer-implemented method of claim 14, wherein the first rank is the high rank and further comprising, in response to the outcome and prior to the re-spinning, upgrading the stack of symbols of the first rank to a stack of symbols having a fourth rank.

16. The computer-implemented method of claim 13, further comprising displaying on the electronic display device a first array and a second array arranged in a side-by-side configuration, each of the first and second arrays having a respective plurality of columns, the first array including the first column and the second array including the second column.

17. The computer-implemented method of claim 13, further comprising displaying on the electronic display device an arrangement of five columns for the at least one array.

* * * * *